US010405577B2

(12) United States Patent
Montgomery

(10) Patent No.: US 10,405,577 B2
(45) Date of Patent: Sep. 10, 2019

(54) WEARABLE VAPORIZER APPARATUS SYSTEM

(71) Applicant: Montgomery Research and Development LLC, Lawrence, KS (US)

(72) Inventor: Brenton S. Montgomery, Lawrence, KS (US)

( * ) Notice: Subject to any disclaimer, the term of this patent is extended or adjusted under 35 U.S.C. 154(b) by 932 days.

(21) Appl. No.: 14/977,266

(22) Filed: Dec. 21, 2015

(65) Prior Publication Data

US 2016/0174607 A1 Jun. 23, 2016

Related U.S. Application Data

(60) Provisional application No. 62/094,254, filed on Dec. 19, 2014.

(51) Int. Cl.
*A24F 47/00* (2006.01)

(52) U.S. Cl.
CPC ..... *A24F 47/004* (2013.01)

(58) Field of Classification Search
CPC ..... A24F 47/008; A24F 15/18; A24F 47/002; A24F 47/00; A24F 1/30; A24F 47/004; A61M 15/06; A61M 2205/8206; A61M 11/042; A61M 15/00; A61M 15/0001; A61M 15/0021; A24B 15/16; A24B 15/167; F16B 7/105
See application file for complete search history.

(56) References Cited

U.S. PATENT DOCUMENTS

| | | | | |
|---|---|---|---|---|
| 2,456,451 | A * | 12/1948 | Seaver | A61M 15/00 128/203.23 |
| 5,416,953 | A | 5/1995 | Hui | |
| 6,223,744 | B1 * | 5/2001 | Garon | A61M 15/00 128/200.14 |
| D705,918 | S | 5/2014 | Robinson et al. | |
| 2002/0179134 | A1 * | 12/2002 | Suh | E04H 15/46 135/141 |
| 2015/0257451 | A1 * | 9/2015 | Brannon | A24F 47/008 131/328 |

* cited by examiner

*Primary Examiner* — Peter S Vasat
*Assistant Examiner* — Margaret M Luarca
(74) *Attorney, Agent, or Firm* — Law Office of Mark Brown, LLC; Christopher M. DeBacker

(57) ABSTRACT

A wearable vaporizer having a housing for receiving a cartridge full of juice or other material which may be heated by the vaporizer. A mouthpiece extends out from the housing and allows air to be drawn through the mouthpiece, across the cartridge, and thereby drawing heated juices or other substances from the cartridge through the mouthpiece. The mouthpiece can be stored within the housing and withdrawn by pulling on a crown which releases an inner tube of the mouthpiece.

9 Claims, 7 Drawing Sheets

WEARABLE VAPORIZER APPARATUS SYSTEM

CROSS REFERENCE TO RELATED APPLICATION

This application claims priority in U.S. Provisional Patent Application No. 62/094,254, filed Dec. 19, 2014, which is incorporated herein by reference.

BACKGROUND OF THE INVENTION

1. Field of the Invention

The present invention relates generally to a wearable vaporizer, and more specifically to a portable, wearable vaporizer comprised of a main body, a vaporizer unit, and multiple links which can wrap around a wrist.

2. Description of the Related Art

Vaporizer inhalation devices have become increasingly popular. They are widely considered a safer alternative to smoking using traditional methods. Typically, a vaporizer unit is a standalone unit which must be carried by the user separate from all other accessories the user must also be carrying. This can be burdensome to the user, and the vaporizer unit may be misplaced, lost, or otherwise damaged while being transported in a user's pocket or other storage device. What is needed is a simple system for transporting the vaporizer device which will not result in damage or loss to the vaporizer device.

Heretofore there has not been available a wearable vaporizer apparatus with the advantages and features of the present invention.

SUMMARY OF THE INVENTION

The present invention generally provides a wearable vaporizer constructed from several links. The resulting product is a wrist-worn, versatile, extremely mobile, lightweight, battery-operated vaporizer that is easily accessed, used, and worn. Depending on the user's preference, it can accommodate to any of the widely available forms of vaporizer "juices", concentrates, waxes, oils, dry tobacco, dry herbs, dry flowers, and in any combination with each other or by themselves.

An embodiment of the present invention includes a housing for receiving a cartridge full of juice or other material which may be heated by the vaporizer. A mouthpiece extends out from the housing and allows air to be drawn through the mouthpiece, across the cartridge, and thereby drawing heated juices or other substances from the cartridge through the mouthpiece. The mouthpiece can be stored within the housing and withdrawn by pulling on a crown which releases an inner tube of the mouthpiece.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Wearable Vaporizer 2

The wearable vaporizer 2 is primarily designed to be a wrist worn, versatile, extremely mobile, lightweight, battery-operated vaporizer that is easily accessed, used, and worn. Depending on the user's preference, it can accommodate to any of the widely available forms of vaporizer "juices", concentrates, waxes, oils, dry tobacco, dry herbs, dry flowers, and in any combination with each other or by themselves. This invention is a remedy for losing/breaking traditional electronic cigarettes ("e-cigarettes") or vaporizers which would also be marketable and appeal to the informed consumer as well.

Figure 1:
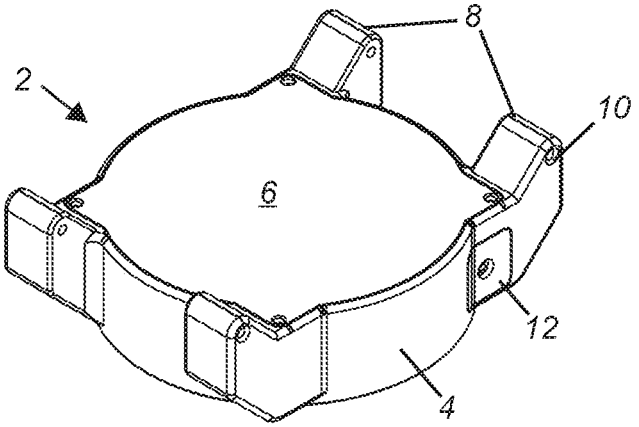
FIG. 1 is a three-dimensional isometric view of elements of a preferred embodiment of the present invention.
Figure 2:
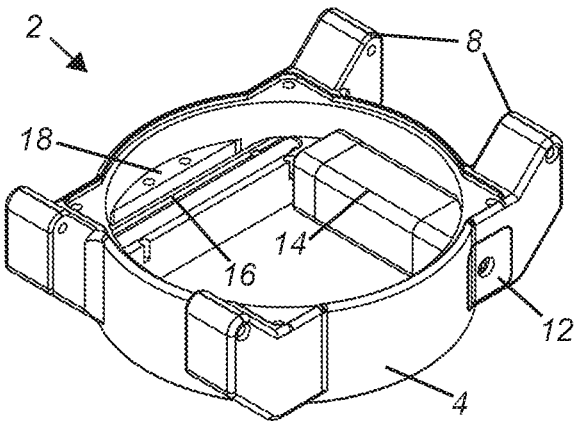
FIG. 2 is a three-dimensional isometric view of elements of a preferred embodiment of the present invention with a back plate element removed, showing internal elements.

As shown in the figures, FIGS. 1 and 2 show a preferred embodiment wearable vaporizer system 2 includes primarily a housing 4 having a back plate 6. Two ends of the body 4 include linking arms 8 having pin holes 10 for receiving a pin which allows links 46 or other connectors forming a wrist strap to connect to the housing 4. This allows the system 2 to be worn about a user's wrist. The back plate 6 affixes to the body of the housing 4 via screws or other method of attachment and conceals the inner components shown in FIG. 2.

In an alternative embodiment, the links 46 are connected and are airtight, and include a bore connecting the links together with an airtight chamber for transferring the vapor.

Figure 3:
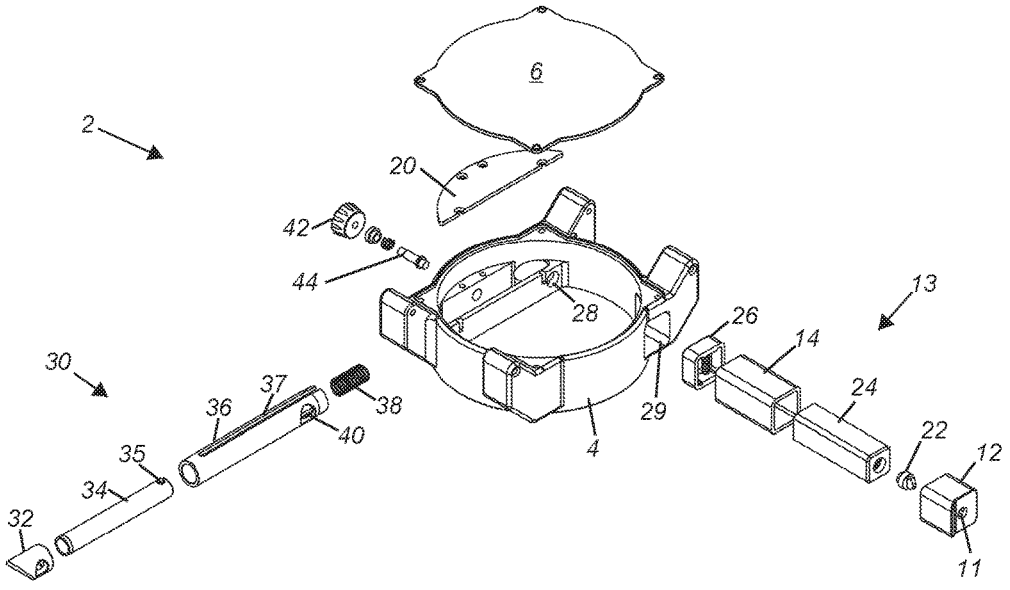
FIG. 3 is an exploded three-dimensional isometric view of elements of a preferred embodiment of the present invention.
Figure 4:
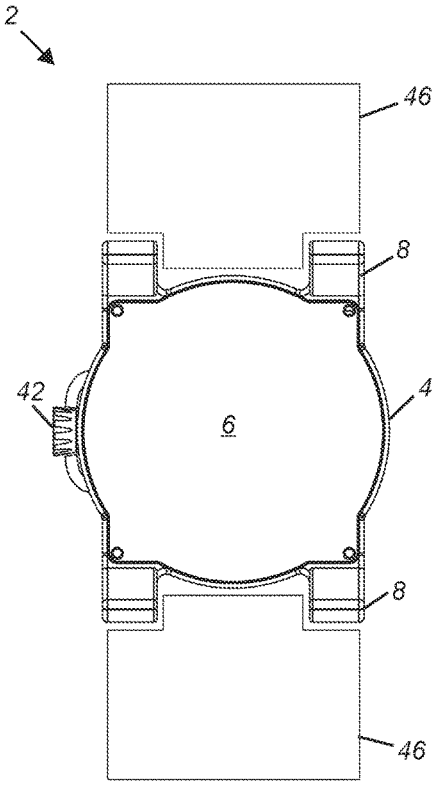
FIG. 4 is a bottom plan view of a preferred embodiment of the present invention.
Figure 5:
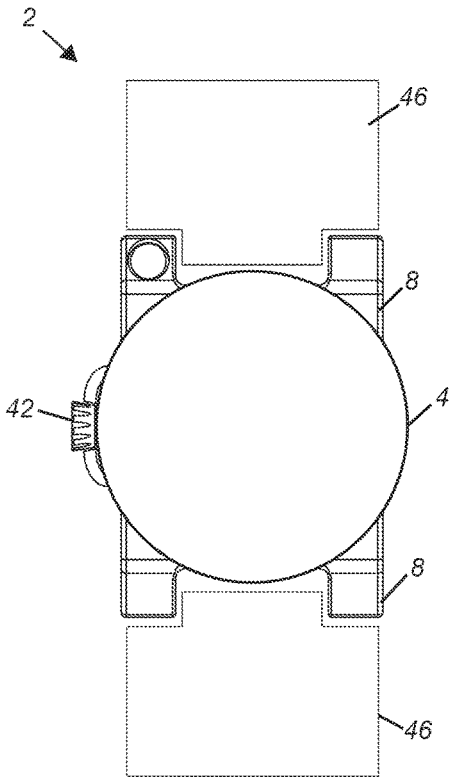
FIG. 5 is a top plan view thereof.

FIG. 3 shows additional detail of the construction of the wearable vaporizer system 2. A cartridge 13 is inserted into a cartridge receiver port 29 within the housing 4. The cartridge generally includes an end cap 12 with an opening 11. A tank 24 with a plug 22 contains the juice which contains the flavored product which becomes vaporized. The tank 24 is contained within a sleeve 14. A gap is located between the sleeve 14 and the tank 24. The gap contains air, and air may be drawn through the opening 11 of the cap 12. The heating element 26 heats the tank 24, which vaporizes the juice contained within, and which is then drawn out of the cartridge 13 into the mouthpiece 30. The cover plate 20 attaches to the cover plate receiver 18 which encloses the airspace and the mouthpiece 30.

Figure 10:
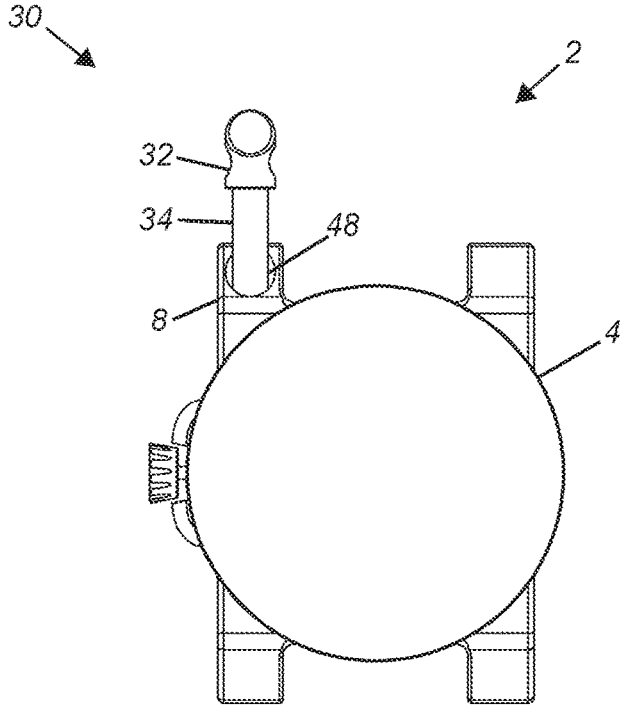
FIG. 10 is a top plan view thereof.
Figure 11:
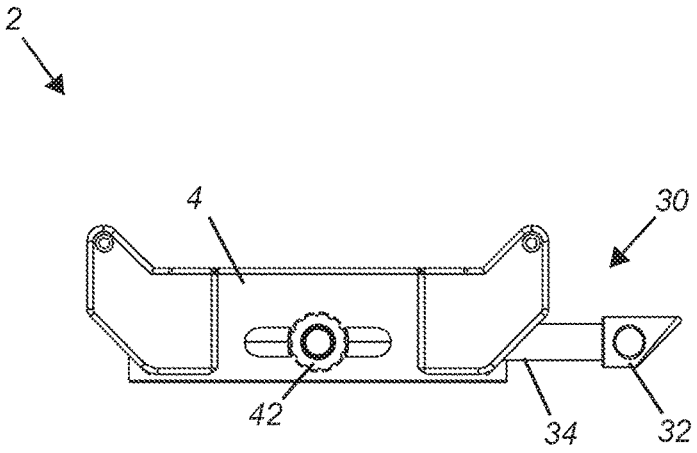
FIG. 11 is a left-side elevation thereof.

The mouthpiece 30 is inserted into the housing 4 via a receiver slot 48 shown in FIG. 10. The mouthpiece 30 is generally constructed from a mouthpiece tip 32 which screws onto an inner mouthpiece tube 34 which is hollow. The inner mouthpiece tube 34 is received in an outer mouthpiece tube 36. A locking nub 35 of the inner mouthpiece tube 34 is received within a slot 37 of the outer mouthpiece tube 36 and allows the inner tube to slide along the outer tube, but not be drawn out of the outer tube. A spring 38 allows the mouthpiece 30 to spring out from the recess 16 of the housing 4 when in use, and allows the mouthpiece to be forced back into the recess 16 when not in use.

The air receiver 40 receives a combination of air and vapor from the cartridge 13 drawn through a receiving hole 28 within the housing. A connector 27 within the heating element 26 connects the carriage to the receiving hole 28 and allows the vapor to be drawn into the mouthpiece 30. The connector 27 also connects to the battery (not shown) for powering the heating element 26. A wick and absorption pad located within the heating element 26 soaks up the heated oil from the tank 24 which mixes with air.

Figure 6:
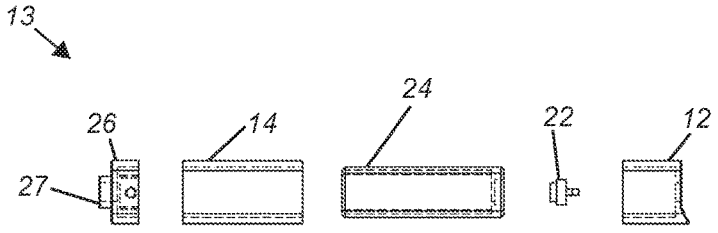
FIG. 6 is an exploded elevational view of component elements contained in a preferred embodiment of the present invention.
Figure 7:
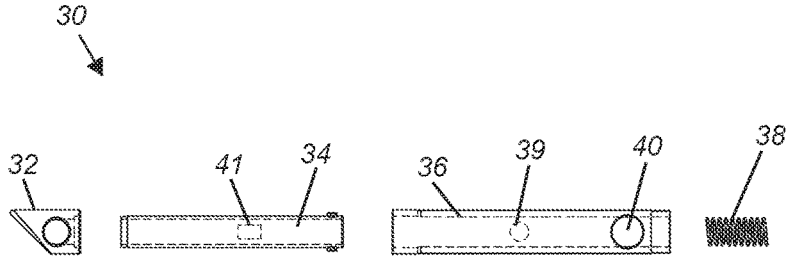
FIG. 7 is an exploded elevational view of component elements contained in a preferred embodiment of the present invention.
Figure 8:
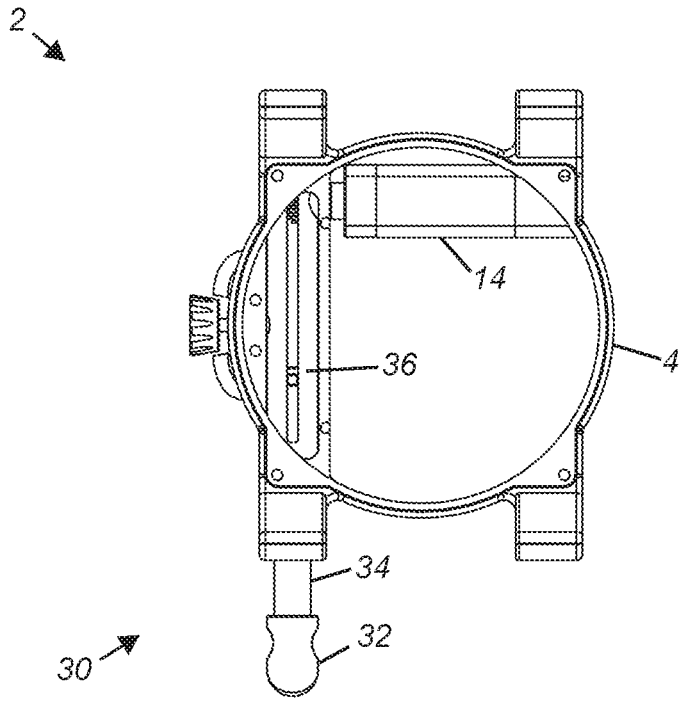
FIG. 8 is a bottom plan view of elements of a preferred embodiment of the present invention with a lid element removed showing internal components.
Figure 9:
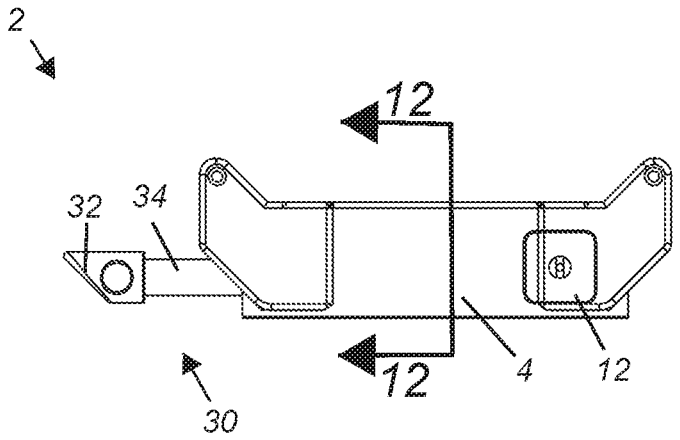
FIG. 9 is a right-side elevation thereof.
Figure 12:
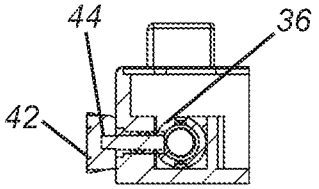
FIG. 12 is a section taken about the line of FIG. 9.

The crown 42 connects to the housing 4 with pin 44. A spring allows the crown and pin to be pushed and pulled. The end of the pin 44 locks into a notch 41 within the inner mouthpiece tube 34, and the entire pin passes through an opening 39 the outer mouthpiece tube 36. The user can pull the crown 42 which pulls the pin 44 out of the notch 41, allowing the spring 38 to push the inner mouthpiece tube 34 away from the spring, allowing the mouthpiece to be partially withdrawn from the housing 4 as shown in FIGS. 6 and 8. This provides easy access for the user to draw vapor through the mouthpiece tip 32. The inner mouthpiece tube 34 can then be pushed back into the outer mouthpiece tube 36, and locked into place via the pin 44 setting within the notch 41. The section shown in FIG. 12 gives an ideal view of how these pieces lock together. The locking nub 35 prevents the inner mouthpiece tube 34 from sliding out of the outer mouthpiece tube 36 due to being locked into the slot 37. Alternatively, the mouthpiece could be operated without a crown by depressing the mouthpiece slightly which unlocks the mouthpiece using a release mechanism. This mechanism would then be relocked by depressing the mouthpiece again, engaging the release mechanism.

In practice, the wearable vaporizer is loaded with a cartridge 13 which is then activated and heated by a battery powering the heat source 26. The crown is pulled which ejects the mouthpiece 30 from the housing 4. The user draws air through the mouthpiece via the mouthpiece tip 32. Air is drawn into the inlet 11 within the end cap 12 of the cartridge 13. The air mixes with juice from the heated cartridge and is drawn through the connector 27 of the cartridge, through the receiving hole 28 within the housing 4 and into the mouthpiece outer tube 36 via the opening 40 within the outer tube. This mixture of air and vapor travels through the inner mouthpiece tube 34 and out of the mouthpiece tip 32. The wearable vaporizer system 2 is secured to the user's wrist during the entire action via a plurality of links 46 or a strap.

The materials used to construct the main link segments will include, in singular or in combination, but are not limited to, Brass, Bronze, Mild steel, Stainless steel, Inconel, Damascus steel or Damasteel, Titanium, Timascus or Titanium Damascus, Silver, Gold, White Gold, and Platinum. Neodymium magnets, epoxy resin, and ABS and/or PLA types of plastic will be used in the construction of the vaporizer cartridges and the internal wiring along with the usage of carbon nanotube wiring also known as "Bucky Paper". Rechargeable graphene Ion batteries will also be used in the battery compartments, as well as the use of ceramic or ceramic composite for a chamber to contain the high heat of a heating coil or element inside of each cartridge.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A wearable vaporizer system comprising:

a housing having a hollow interior space, a mouthpiece recess, a mouthpiece receiver slot, a cartridge receiver port, connecting arms for receiving a strap, and a cartridge recess;

a cartridge configured for being received into said cartridge recess via said cartridge receiver port;

a mouthpiece comprising an inner mouthpiece tube, an outer mouthpiece tube, and a mouthpiece tip, said mouthpiece configured for being received into said mouthpiece recess and extending beyond said mouthpiece receiver port;

a locking mechanism within said housing, configured to engage said inner mouthpiece tube within said outer mouthpiece tube, said locking mechanism configured to selectively release said inner mouthpiece tube from said outer mouthpiece tube;

said strap affixed to said connecting arms and configured to secure said housing about an object;

said cartridge comprising a first end cap having an air opening, a tank containing a vaporizable substance and a closure plug, a sleeve surrounding said tank, an air gap between said tank and said sleeve, and a second end cap including a heating element and a connector having an air opening;

said connector connecting said heating element to a battery;

said heating element configured to heat said vaporizable substance within said tank;

said vaporizable substance configured to be transformed into a vapor via said heating element and to be absorbed by an absorption pad via a wick; and said vapor mixed with air within said second end cap.

2. The system of claim 1, wherein said vaporizable substance is selected from the list comprising: juice; concentrate; wax; oil; dry tobacco; dry herbs; and dry flowers.

3. The system of claim 1, further comprising said mouthpiece outer tube including an opening for receiving a mixture of vapor and air from said second end cap via said air opening of said connector.

4. The system of claim 1, further comprising:

said locking mechanism comprising a crown connected to said housing via a crown pin and a spring, said crown configured to be withdrawn partially away from said housing, thereby releasing said inner mouthpiece tube from said outer mouthpiece tube.

5. The system of claim 4, further comprising:

said mouthpiece inner tube including a notch configured to receive said crown pin; and said mouthpiece outer tube including an opening corresponding with said crown pin, allowing said crown pin to pass through said mouthpiece outer tube and to interlock within said notch of said mouthpiece inner tube.

6. The system of claim 1, further comprising:

said mouthpiece inner tube including a proximal end and a distal end, said mouthpiece tip screwed onto said mouthpiece inner tube proximal end, and a locking nub located in proximity to said mouthpiece inner tube distal end;

said mouthpiece outer tube including a proximal end, a distal end, a slot running longitudinally along said mouthpiece outer tube and terminating short of said mouthpiece outer tube proximal end;

wherein said locking nub is slidingly engaged within said slot; and wherein said locking nub is configured to prevent said mouthpiece inner tube from sliding beyond said mouthpiece outer tube proximal end.

7. The system of claim 6, further comprising said mouthpiece outer tube including an opening for receiving a mixture of said vapor and said air from said second end cap via said air opening of said connector.

8. A wearable vaporizer system comprising:

a housing having a hollow interior space, a mouthpiece recess, a mouthpiece receiver slot, a cartridge receiver port, connecting arms for receiving a strap, and a cartridge recess;

a cartridge configured for being received into said cartridge recess via said cartridge receiver port;

said cartridge comprising a first end cap having an air opening, a tank containing a vaporizable substance and a closure plug, a sleeve surrounding said tank, an air gap between said tank and said sleeve, and a second end cap including a heating element and a connector having an air opening;

said connector connecting said heating element to a battery;

said heating element configured to heat said vaporizable substance within said tank;

said vaporizable substance configured to be transformed into a vapor via said heating element and to be absorbed by an absorption pad via a wick;

said vapor mixed with air within said second end cap;

a mouthpiece comprising an inner mouthpiece tube, an outer mouthpiece tube, and a mouthpiece tip, said mouthpiece configured for being received into said mouthpiece recess and extending beyond said mouthpiece receiver port;

said mouthpiece inner tube including a notch configured to receive said crown pin;

said mouthpiece outer tube including an opening corresponding with said crown pin, allowing said crown pin to pass through said mouthpiece outer tube and to interlock within said notch of said mouthpiece inner tube;

said mouthpiece inner tube including a proximal end and a distal end, said mouthpiece tip screwed onto said mouthpiece inner tube proximal end, and a locking nub located in proximity to said mouthpiece inner tube distal end;

said mouthpiece outer tube including a proximal end, a distal end, a slot running longitudinally along said mouthpiece outer tube and terminating short of said mouthpiece outer tube proximal end;

wherein said locking nub is slidingly engaged within said slot;

wherein said locking nub is configured to prevent said mouthpiece inner tube from sliding beyond said mouthpiece outer tube proximal end a crown connected to said housing via a crown pin and a spring, said crown configured to be withdrawn partially away from said housing, thereby releasing said inner mouthpiece tube from said outer mouthpiece tube; and said strap affixed to said connecting arms and configured to secure said housing about an object.

9. The system of claim 8, wherein said vaporizable substance is selected from the list comprising: juice; concentrate; wax; oil; dry tobacco; dry herbs; and dry flowers.

* * * * *